US005865270A

United States Patent [19]

Strength et al.

[11] Patent Number: 5,865,270

[45] Date of Patent: Feb. 2, 1999

[54] EXPANDABLE JACK

[76] Inventors: Tex Strength; Jody R.A. Strength, both of 879 9th Ave., Pace, Fla. 32571

[21] Appl. No.: 879,643

[22] Filed: Jun. 20, 1997

[51] Int. Cl.[6] ..... E04G 1/22

[52] U.S. Cl. ..... 182/186.6; 182/179.1

[58] Field of Search ..... 182/179.1, 178.5, 182/178.1, 178.6, 186.6, 186.7, 186.9

[56] References Cited

U.S. PATENT DOCUMENTS

| | | | |
|---|---|---|---|
| 2,360,999 | 10/1944 | Wyen | 182/178.5 |
| 2,599,670 | 6/1952 | Thomas | 182/186.6 |
| 3,071,204 | 1/1963 | Piltingsrud | 182/186.6 |
| 3,564,802 | 2/1971 | Dreyfus | 182/178.1 |
| 3,684,058 | 8/1972 | Brown . | |
| 3,850,264 | 11/1974 | Salinas | 182/178.5 |
| 4,452,337 | 6/1984 | Atzinger | 182/178.5 |
| 5,385,215 | 1/1995 | Williams | 182/129.1 |
| 5,456,334 | 10/1995 | Brignac | 182/186.6 |

*Primary Examiner*—Alvin Chin-Shue
*Attorney, Agent, or Firm*—Peter Loffler

[57] ABSTRACT

An expandable jack that is stackable, is provided with four base members having vertical columns extending upwardly therefrom. A horizontal cross-member structure, having width adjustment capability, is adapted to slide along the height of a pair of vertical columns and once appropriately height positioned to be locked into place. One of the cross-members of the cross-member structure has height adjustment capability. The device permits quick and easy height or width adjustment and also permits quick and easy height adjustment of one or two horizontal cross-members.

9 Claims, 8 Drawing Sheets

EXPANDABLE JACK

BACKGROUND OF THE INVENTION

1. Field of the Invention

The present invention relates to a jack system capable of horizontal expansion, vertical expansion, cross-member adjustment, and vertical stacking.

2. Background of the Prior Art

The use of jack systems is almost universal in most construction sites. The jacks permit workers to perform tasks at various heights along the construction job with relative safety. The art is replete with various types of jacks having a variety of features and designs.

There are some desirable features associated with jack systems that have not been adequately addressed by the prior art systems. Specifically, workers may want to vary the width of a jack system in order to accommodate more works, more supplies, or a large piece of machinery to perform the job at hand. While a second jack may be placed behind the first jack in order to expand the width of the jack work site, this solution has drawbacks in that system stability is lessened especially in high elevation jacks. Furthermore, the use of two separate jacks is required.

Another desirable feature that is not adequately addressed by the prior art is the stackability of jack systems. Although jack systems are regularly stacked, the stacking mechanism is usually cumbersome and time-consuming to utilize.

A final feature not addressed by the prior art is the need to vary the relative height of the cross-members. For example, a brick mason may continually want to increase the height of the cross-members upon which he has placed a plank which holds his bricks as he continues to raise the level at which he is placing the bricks onto the building. This allows the brick mason to gain and cleaner access to his supplies and materials.

Therefore, there is a need in the art for a jack system that is capable of expanding along its width and that is easily stackable. Furthermore, the jack must have variable height cross-members. Ideally, such a jack system will be easy to use and be of relatively straightforward design and construction.

SUMMARY OF THE INVENTION

The expandable jack of the present invention addresses the aforementioned needs in the art. The expandable jack is capable of being expanded along its width and along its height. One of the horizontal cross-members on each side of the expandable jack is height adjustable. The entire device is stackable.

The expandable jack is a generally rectangular member having a length, a width, and a height. A base member is positioned at each of its four corners. A vertical adjustment column extends upwardly from each base member. A horizontal cross-member structure is adapted to slide up and down along each pair vertical adjustment columns that define the width of the device. The horizontal cross-member structure is width adjustable. A pair of cross-members extend between device halves along one or both lengths.

The device is simple and easy to assemble, use and adjust. It is easily collapsible for simple storage and transport. It is of straightforward design and construction.

BRIEF DESCRIPTION OF THE DRAWINGS

Similar reference numerals refer to similar parts throughout the several views of the drawings.

DESCRIPTION OF THE PREFERRED EMBODIMENT

Figure 3:
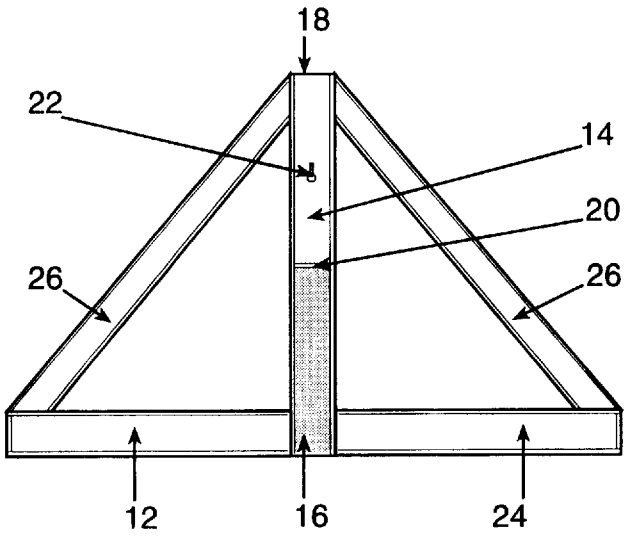
FIG. 3 is a cutaway view of the base member.
Figure 4:
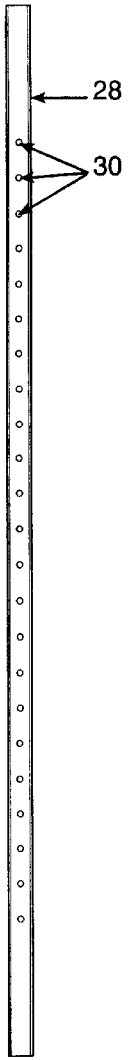
FIG. 4 is a front elevation view of the vertical expansion column.
Figure 5:
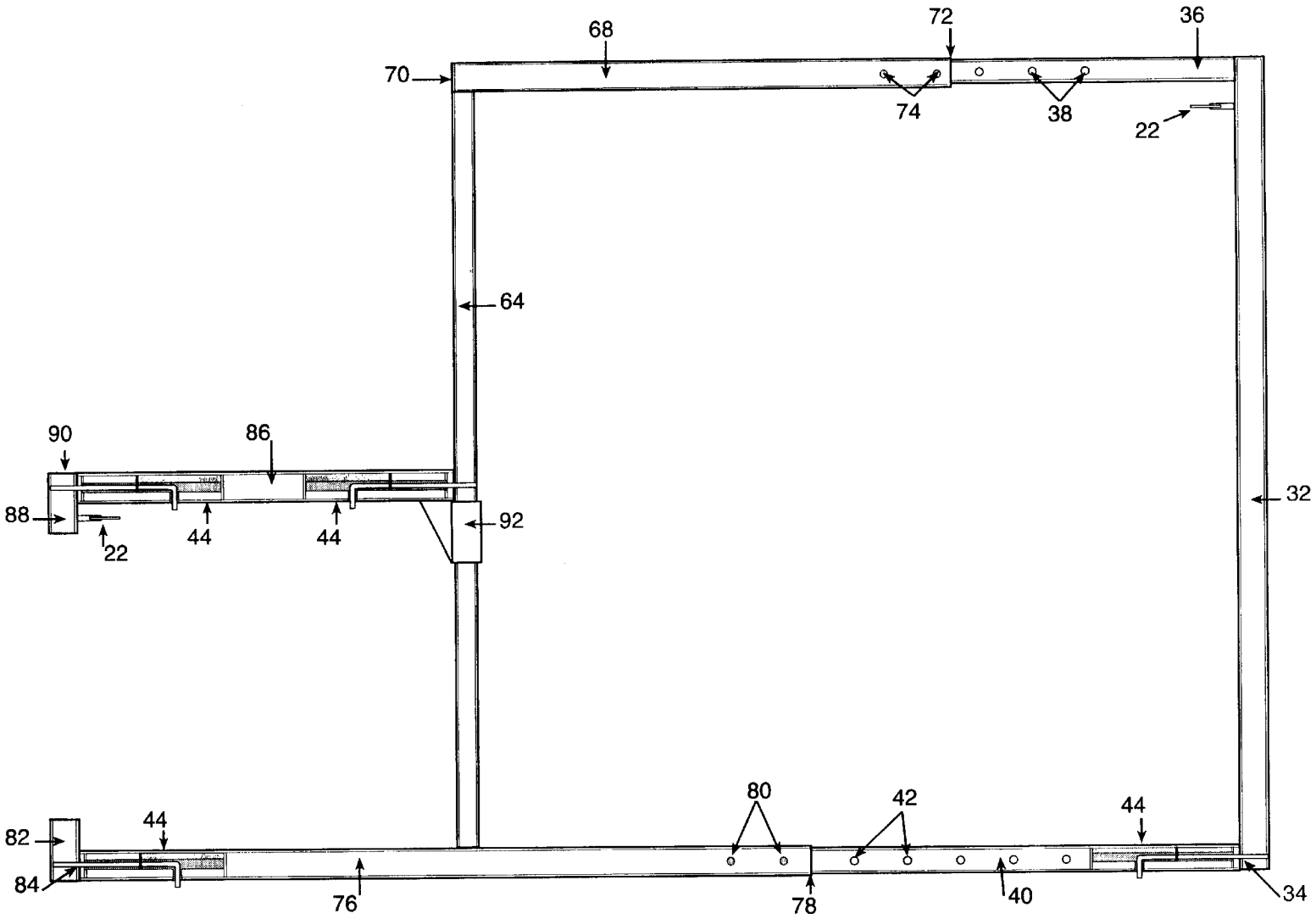
FIG. 5 is a front elevation view of the horizontal cross-member structure.

Referring now to the drawings, it is seen that the expandable jack of the present invention, generally denoted by reference numeral 10, is comprised of four base members 12 in spaced apart generally rectangular fashion. The base members 12 delimit the lower four corners of the expandable jack 10. As seen in FIG. 3, each base member 12 is of a generally A-frame design and is comprised of a vertical member 14 that has an open lower end 16 and an open upper end 18 separated by a cap 20. A nipple lock 22 extends outwardly from the vertical member 14. A pair of horizontal members 24 extend outwardly in opposing directions from the vertical member 14 proximate the lower end 16. A pair of diagonal members 26 extend diagonally upwardly from the outer end of each horizontal member 24 and attach to the vertical member 14. A vertical expansion column 28 is insertable into the open upper end 18 of the vertical member 14 and abuts against the cap 20 in order to prevent further downward movement therein. Alternately, the vertical expansion column 28 can be welded into place within the vertical member 14 thereby dispensing with the need for the cap 20. The cross-section of the vertical expansion column 28 is slightly less than the cross-section of the vertical member 14 for a relatively snug fit. As seen, the vertical expansion column 28 has plurality of aligned aperture pairs 30 (only one aperture of each pair illustrated) located along its height.

A pair of first vertical stable columns 32 are each hollow tubular members that have a cross-section somewhat larger than the cross-section of the vertical expansion column 28 such that the first vertical stable column 32 fits over and encompasses the vertical expansion column 28 and is free to slide up and down the vertical expansion column 28 as required. A pair of aligned apertures 34 (only one illustrated) are located on each first stable vertical column 32 proximate its bottom. A first horizontal expansion column 36 extends outwardly from each first vertical stable column 32 proximate its top. Each first horizontal expansion column 36 has a plurality of spaced apart aligned aperture pairs 38 (only one of each pair illustrated) located along its length. A nipple lock 22 is located on each first vertical stable column 32 below the first horizontal expansion column 36.

Figure 6:
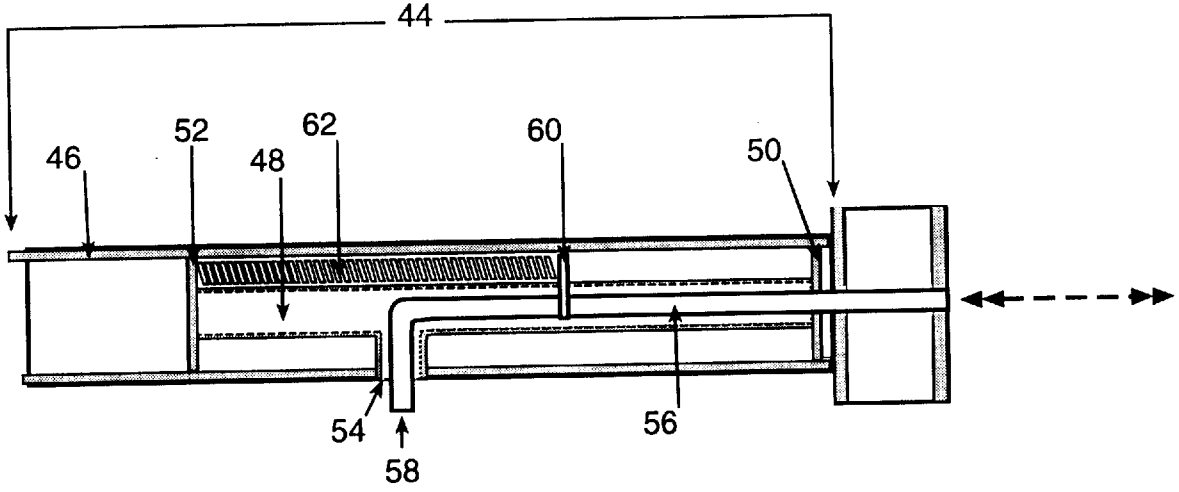
FIG. 6 is a cutaway view of the locking bolt.

A pair of second horizontal expansion columns 40 each have a plurality of spaced apart aligned aperture pairs 42 (only one of each pair illustrated) located along their length. A first locking bolt 44 is located on the end of each second horizontal expansion column 42. As seen in FIG. 6, the locking bolt 44 is comprised of a tubular member 46 having a locking track 48 delimited by a front plate 50 and a rear plate 52. The locking track 48 has a vertical relief 54 extending downwardly in generally perpendicular fashion proximate its medial portion. A locking pin has a body portion 56 and an end portion 58. A pressure plate 60 is attached to the body portion 56 of the locking pin. A tension spring 62 has one end abutting the rear plate 52 and the opposing end abutting the pressure plate 60. As seen, the locking pin is free to slide back and forth through the locking track 48 whenever its end portion 58 is in a generally horizontal position aligned with the locking track 48. The body portion 56 may be slid into or out of an aperture as desired. The spring 62 tends to force the locking pin forwardly. When the end portion 58 of the locking pin is received within the relief portion 54 the locking pin is locked into position. The spring 62 assures this locked position. The pressure plate 62 is dimensioned to maintain spring 60 contact irrespective of locking pin rotative positioning.

A pair second vertical stable columns 64 each have a plurality of spaced apart aligned aperture pairs 66 (only one of each pair illustrated) located along their height. A third horizontal expansion column 68 extends outwardly from each second vertical stable column 64 proximate its top. The third horizontal expansion column 68 is a hollow tubular member having a closed end 70 and an open end 72 and has a cross-section that is slightly larger than the cross-section of the first horizontal expansion column 36 such that the first horizontal expansion column 36 is received within the open end 72 and is adapted to slide within the third horizontal expansion column 68. At least one pair of aligned apertures 74 (only one aperture of each aperture pair illustrated) are located on the third horizontal expansion column 68 proximate its open end 72. Each of the aperture pairs 74 of the third horizontal expansion column 68 are registerable with an aperture pair 38 of the first horizontal expansion column 36. A fourth horizontal expansion column 76 extends outwardly from each second vertical stable column 64 in T-formation, proximate the second vertical stable column's lower end. As seen, the fourth horizontal expansion column 76 has an open first end 78 that has a cross-section that is slightly larger than the cross-section of the second horizontal expansion column 40 such that the second horizontal expansion column 40 is received within the open end 78 and is adapted to slide within the fourth horizontal expansion column 76. At least one pair of aligned apertures 80 (only one aperture of each aperture pair illustrated) are located on each fourth horizontal expansion column 76 proximate its open end 78. Each of the aperture pairs 80 of the fourth horizontal expansion column 76 are registerable with an aperture pair 42 of the second horizontal expansion column 40. As seen, a second locking bolt 44 is located on the other end of each fourth horizontal expansion column 76. A first collar 82 is attached to the second locking bolt 44 and has a pair of aligned apertures 84 to permit passage of the locking pin therethrough. The first collar 82 is a hollow member having a cross-section that is slightly larger than the vertical expansion column 28 and is adapted to slide up and down along the height of the vertical expansion column 28.

A sliding column 86 is a horizontal tube member having a third locking bolt 44 on one end and a fourth locking bolt 44 on the opposing end. A second collar 88 is attached to the third locking bolt 44 and has a pair of aligned apertures 90 to permit passage of the locking pin therethrough. The second collar 88 is a hollow member having a cross-section that is slightly larger than the vertical expansion column 28 and is adapted to slide up and down along the height of the vertical expansion column 28. A nipple lock 22 is attached to the second collar 88. A third collar 92 is attached to the fourth locking bolt 44 and is generally positioned below the fourth locking bolt 44 to permit alignment of the sliding column 86 with the third horizontal expansion column 68. The third collar 92 is a hollow member having a cross-section that is slightly larger than the second vertical stable column 64 and is adapted to slide up and down along the height of the second vertical stable column 64.

Cross-members 94 are attached to diagonally opposed nipple locks 22. The cross-members 94 are free to rotate about the nipple locks 22.

In order to utilize the expandable jack 10 of the present invention, the base members 12 are positioned at the four corners of the jack 10. A vertical expansion column 28 is positioned into the upper end 18 of each base member 12. The pair of first vertical stable columns 32 are slid onto the two vertical expansion columns 28 located at the outer corners of the jack 10. The first collars 82 of each fourth horizontal expansion column 76 as well as the second collars 88 of the sliding column 86 are slid onto the two remaining vertical expansion columns 28 located at the inner corners of the expandable jack 10. Each first horizontal expansion column 36 is slid into its corresponding third horizontal expansion column 68 while each second horizontal expansion column 40 is slid into its corresponding fourth horizontal expansion column 76. The respective columns are positioned for their desired width and each first horizontal expansion column 36 is secured to its third horizontal expansion column 68. This securement is accomplished by aligning each of the at least one aperture pairs 74 of the third horizontal expansion column 68 with an appropriate aperture pair 38 of the first horizontal expansion column 36. A securement means, such as a bolt is inserted through each pair of the aligned aperture pairs and secured therein by an appropriate nut, such as a wing nut. Alternately, a cotter pin or other similar device can be used for column securement. Each second horizontal expansion column 40 is secured to its fourth horizontal expansion column 76 in similar fashion.

The desired height of each first vertical stable column 32 relative to the vertical expansion column 28 is selected and the locking pin of the first locking bolt 44 is slid through the appropriate aperture pair 30 of the vertical expansion column 28. The locking pin of the second locking bolt 44 is slid into the appropriate aperture pairs 30 of the opposing vertical expansion column 28. Thereafter, the sliding column 86 is slid into its desired height and the locking pin of the third locking bolt 44 is slid into the appropriate aperture pairs 30 of the appropriate vertical expansion column 28 while the locking pin of the fourth locking bolt 44 is slid into the appropriate aperture pair 66 of the second vertical stable column 64. It is noted that the aperture pairs 66 of the second vertical stable column 66 are aligned with the aperture pairs 30 of the vertical expansion column 28. Thereafter, a cross-member 94 is attached to the nipple lock 22 on the first vertical stable column 32 and to the opposed nipple lock 22 on the diagonally opposed base member 12. If the sliding column 86 is in its uppermost position, then a cross-member 94 is also attached to the nipple lock 22 on the second collar 88 and the diagonally opposed base member 12.

Due to the length imbalance, if the sliding column 86 is in a position other than its uppermost position, then the cross-member 94 attached to its second collar 88 must be removed. However, with the use of telescoping cross-members (not illustrated), this length imbalance can be overcome, and the cross-members maintained in place irrespective of the sliding column 86 position.

The expandable jack 10 is now usable. The expandable jack 10 is disassembled in reverse fashion.

It is expressly recognized that although the illustrations disclose an expandable jack 10 having its columns with a generally rectangular cross-section, other shapes for the columns, such as circular, can be utilized within the spirit and scope of this present invention.

In order to change the width of the expandable jack 10, each first horizontal expansion column 36 is desecured from its third horizontal expansion column 68 and each second horizontal expansion column 40 is desecured from its fourth horizontal expansion column 76 and each first horizontal expansion column 36 and each third horizontal expansion column 68 are slid into or out of its second horizontal expansion column 40 or fourth horizontal expansion column 76 respectively, as desired. Once the appropriate width is achieved, each first horizontal expansion column 36 is resecured to its third horizontal expansion column 68 and each second horizontal expansion column 40 is resecured to its fourth horizontal expansion column 76.

In order to change the height of the expandable jack 10, the locking pins of the first locking bolts 44, the second locking bolts 44 and the third locking bolts 44 are released from their respective aperture pairs 30 within the respective vertical expansion column 28. The entire structure is height adjusted with respect to the vertical expansion columns 28 and all of the released locking pins are resecured within their appropriate aperture pairs 30 of the vertical expansion columns 28. As the cross-members 94 are free to rotate about their nipple locks 22, the height expansion can be accomplished without detaching the cross-members 94. However, as will be understood, the two halves of the expandable jack 10 will be brought closer together, and thus decreasing device 10 length, with increasing height expansion. The use of telescoping cross-members (not illustrated) will eliminate the required length change with height change.

In order to change the position of a sliding column 86, the locking pin of the third locking bolt 44 is released from the aperture pairs 30 of its vertical expansion column 28 while the locking pin of the fourth locking bolt 44 is released from the aperture pairs 66 of its second vertical stable column 64. The sliding column 86 is slid into its desired position and the locking pin of the third locking bolt 44 is inserted into the appropriate aperture pairs 30 of the vertical expansion column 28 while the locking pin of the fourth locking bolt 44 is inserted into the appropriate aperture pairs 66 of the second vertical stable column 64.

Figure 1:
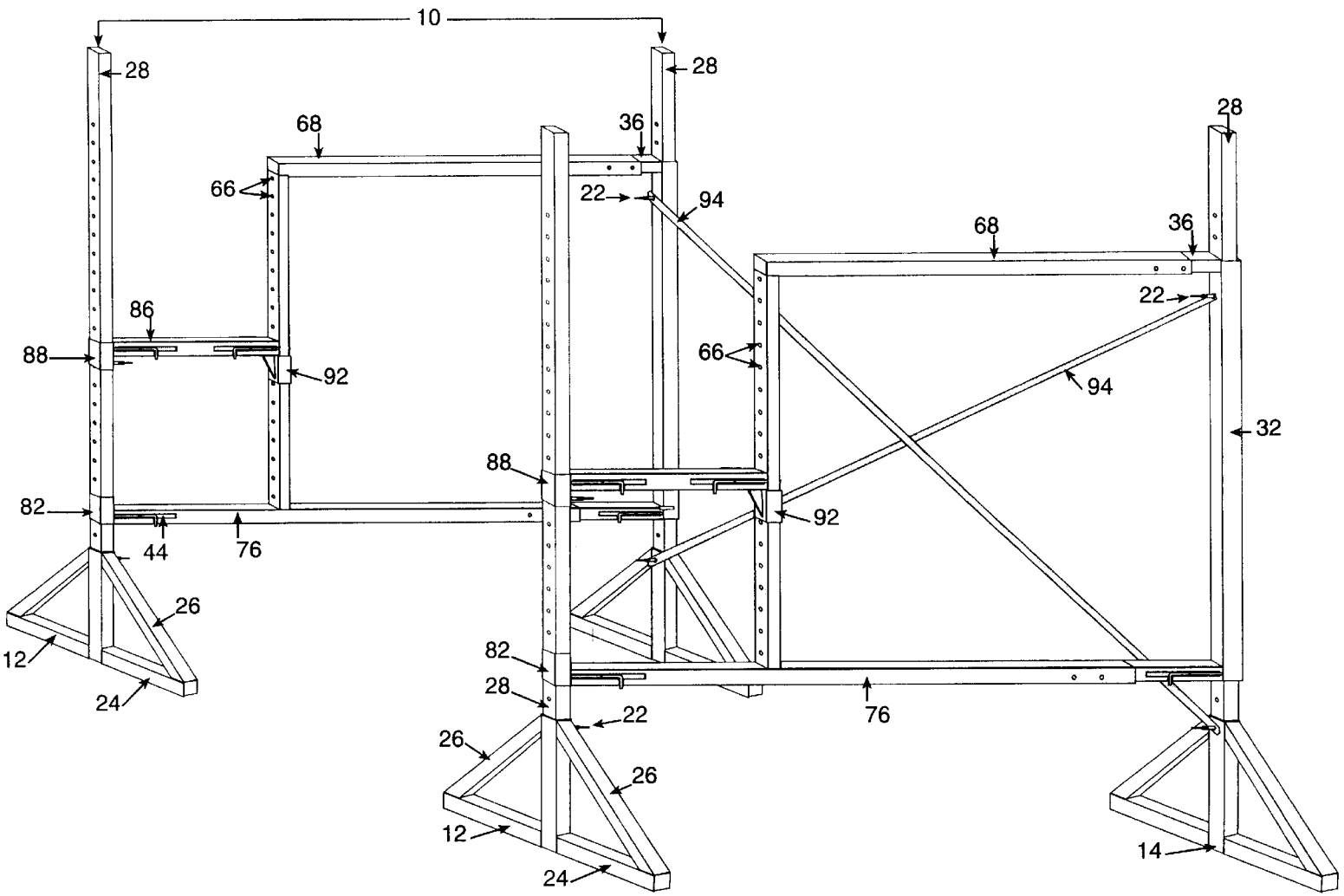
FIG. 1 is a perspective view of the expandable jack of the present invention.
Figure 2:
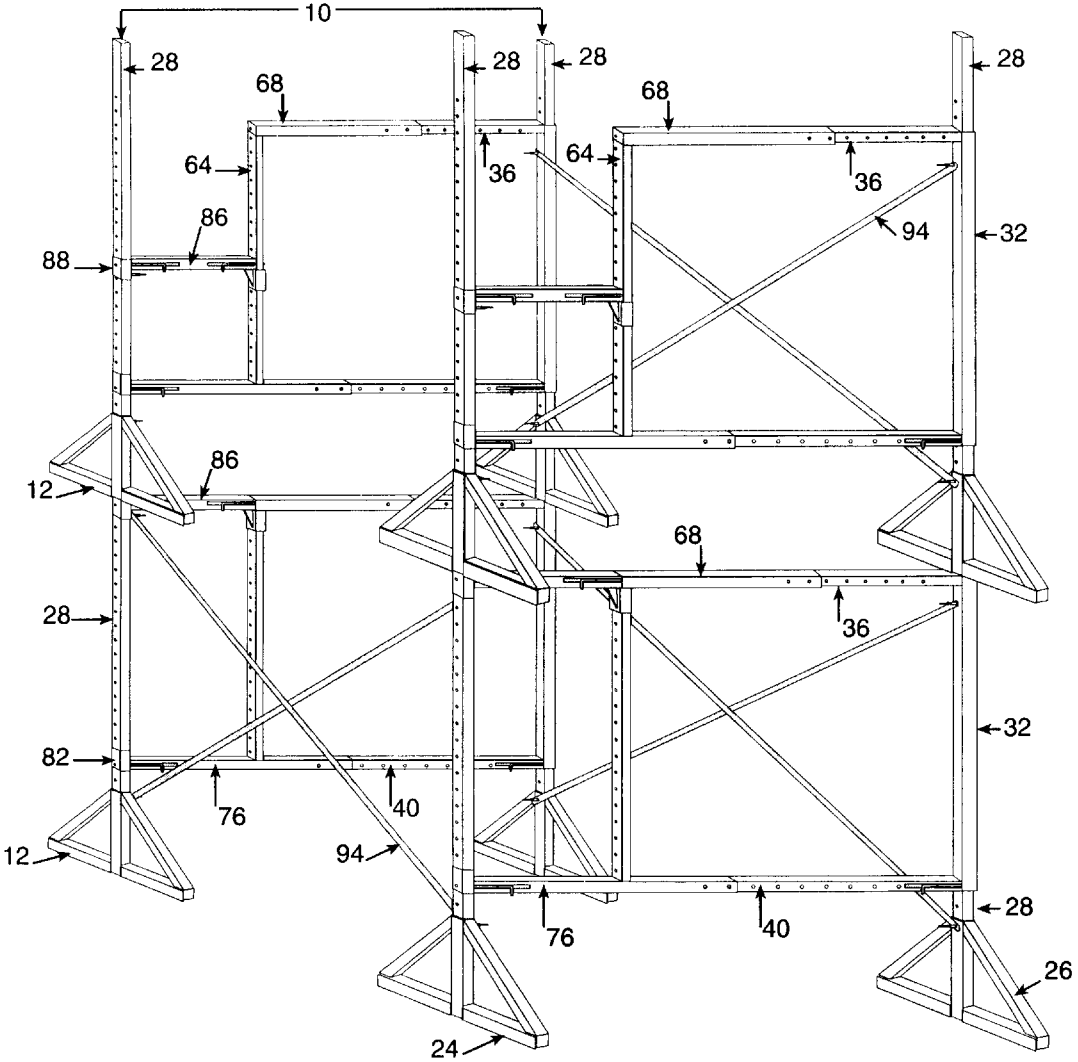
FIG. 2 is a perspective view of a pair of expandable jacks stacked one on the other.
Figure 7:
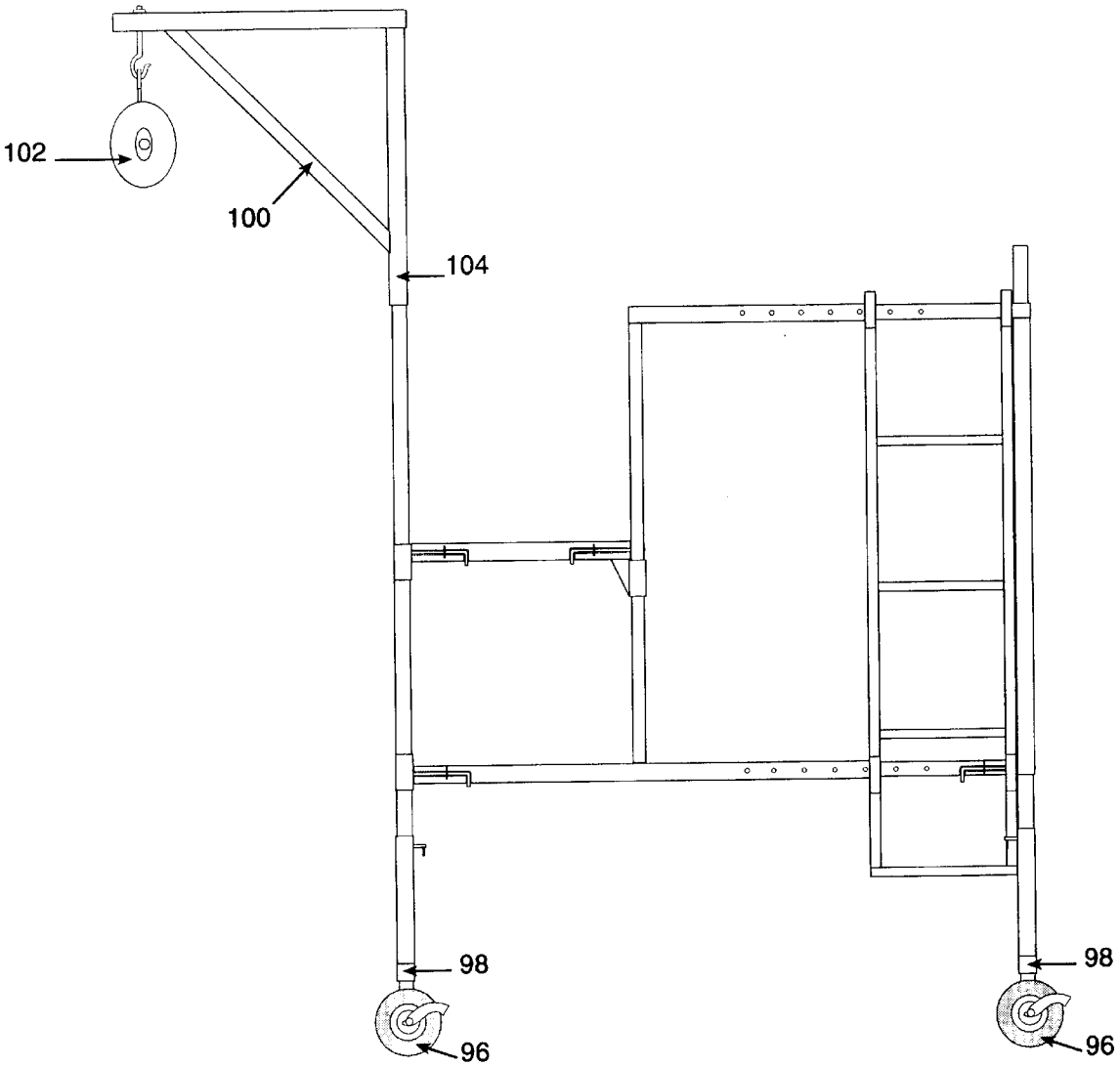
FIG. 7 is a side elevation view of the expandable jack with the wheels, ladder, and lifter attached.
Figure 8:
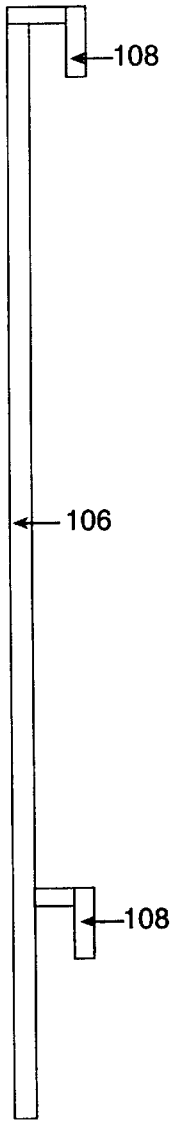
FIG. 8 is a side elevation view of the ladder.

As seen in FIG. 2, the expandable jacks 10 are stackable. The lower end 16 of each base member 12 receives the upper portion of a vertical expansion column 28 (appropriate means can be used to secure the two together, if desired). Additionally, wheels 96, either lockable or not, can have stems 98 that are inserted into the lower ends 16 of each base member 12 to provide the expandable jack 10 with easy mobility. A lifter 100 that has a block and tackle 102 or other similar device thereon, can have a post member 104 having an open lower end that receives the top of one of the vertical expansion columns 28. As seen in FIGS. 7 and 8, a ladder 106 having lower and upper hooks 108 can be removably positioned over the various horizontal expansion columns or can be permanently secured to the second horizontal expansion column 40 and the fourth horizontal expansion column 76.

While the invention has been particularly shown and described with reference to an embodiment thereof, it will be appreciated by those skilled in the art that various changes in form and detail may be made without departing from the spirit and scope of the invention.

We claim:

1. An expandable jack having a generally rectangular shape with four corners, and a pair of lengths, a pair of widths, and a height comprising:

a first pair of base members located at the two corners that define the first width and a second pair of base members located at the remaining two corners that define the second width;

a first pair of vertical columns extending upwardly from each of the first pair of base members and a second pair of vertical columns extending upwardly from each of the second pair of base members;

a first horizontal cross-member structure, having a first width adjustment means, disposed between the first pair of vertical columns and a second horizontal cross-member structure, having a second width adjustment means, disposed between the second pair of vertical columns;

the first horizontal cross-member structure and the second horizontal cross-member structure each comprising:

a first vertical stable column;

a first horizontal column, having a hollow interior, extending outwardly from the first vertical stable column proximate its top;

a second horizontal column, having a hollow first end, attached to the first vertical stable column in T-formation fashion;

a first hollow collar, attached to the second end of the second horizontal column, adapted to slide on one of the vertical columns;

a first securement means for securing the second horizontal column to the one of the vertical columns;

a second vertical stable column having a hollow interior adapted to slide on another of the vertical columns;

a third horizontal column extending outwardly from the top of the second vertical stable column adapted to slide within the first horizontal column;

a second securement means for securing the third horizontal column to the first horizontal column;

a fourth horizontal column adapted to slide within the second horizontal column;

a third securement means for securing the fourth horizontal column to the second horizontal column;

a fifth horizontal column, having a second hollow collar, attached to the first end of the fifth horizontal column adapted to slide on the one of the vertical columns and a third hollow collar attached to the second end of the fifth horizontal column adapted to slide on the first vertical stable column;

a fourth securement means for securing the fourth horizontal column to the one of the vertical columns; and a fifth securement means for securing the fifth horizontal column to the first vertical stable column.

2. The expandable jack as in claim 1 further comprising a height adjustment means for adjusting the height of the expandable jack.

3. The expandable jack as in claim 1 further comprising:

a first cross-member diagonally disposed between the first horizontal cross-member structure and one of the second pair of base members that define the first length; and a second cross-member diagonally disposed between the second horizontal cross-member structure and one of the first pair of base members that define the first length, in opposing direction to the first cross-member.

4. The expandable jack as in claim 3 further comprising:

a third cross-member diagonally disposed between the first horizontal cross-member structure and the other of the second pair of base members that define the second length; and a fourth cross-member diagonally disposed between the second horizontal cross-member structure and the other of the first pair of base members that define the second length, in opposing direction to the third cross-member.

5. The expandable jack as in claim 1 wherein the second securement means and third securement means comprise:

a plurality of aligned first aperture pairs located on the third horizontal column and on the fourth horizontal column in spaced apart relationship;

at least one aligned second aperture pairs located on the first horizontal column, registerable with the first aperture pairs on the third horizontal column, and on the second horizontal column, registerable with the first aperture pairs on the fourth horizontal column; and a first rigid member means insertable through each of the registered first aperture pairs of the first horizontal column and second aperture pairs of the third horizontal column and the registered first aperture pairs of the second horizontal column and second aperture pairs of the fourth horizontal column.

6. The expandable jack as in claim 1 wherein the first securement means, and the fourth securement means, each comprise:

a plurality of aligned first aperture pairs located on each of the vertical columns in spaced apart relation; and a first locking bolt means having a locking pin, removably insertable through one of the aligned first aperture pairs; and wherein the fifth securement means comprises:

a plurality of aligned second aperture pairs located on each of the first vertical stable column in spaced apart relation; and a second locking bolt means having a locking pin, removably insertable through one of the aligned second aperture pairs.

7. The expandable jack as in claim 6 wherein the first locking bolt means and the second locking bolt means each comprise:

a tube member having a hollow locking track;

a first plate located at one end of the locking track and a second plate located at the opposing end of the locking track;

a relief portion extending downwardly from the locking track;

a locking pin having a nonaligned end portion adapted to be received within the relief portion, adapted to slide within the locking track;

a pressure plate attached to the locking pin;

a tension spring having one end abut the first plate and the opposing end abut the pressure plate; and wherein the locking pin can slide within the locking track and is biased forwardly whenever the end is not within the relief portion and the locking pin is locked into position within the locking track and biased forwardly whenever the end is within the relief portion.

8. The expandable jack as in claim 3 wherein each of the first cross-members and the second cross-members is attached to a nipple lock.

9. The expandable jack as in claim 3 wherein each of the first cross-members, the second cross-members, the third cross-members, and the fourth cross-members is attached to a nipple lock.

* * * * *